US006874570B2

(12) United States Patent
Horiuchi

(10) Patent No.: US 6,874,570 B2
(45) Date of Patent: Apr. 5, 2005

(54) INTEGRATED HEAT EXCHANGER

(75) Inventor: Hirofumi Horiuchi, Osaka (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 10/333,925

(22) PCT Filed: Aug. 2, 2001

(86) PCT No.: PCT/JP01/06667

§ 371 (c)(1),
(2), (4) Date: Apr. 29, 2003

(87) PCT Pub. No.: WO02/12817

PCT Pub. Date: Feb. 14, 2002

(65) Prior Publication Data

US 2004/0069446 A1 Apr. 15, 2004

Related U.S. Application Data

(60) Provisional application No. 60/302,383, filed on Jul. 3, 2001.

(30) Foreign Application Priority Data

Aug. 4, 2000 (JP) ..... 2000-236365

(51) Int. Cl.[7] ..... F28D 7/00; F28F 9/007

(52) U.S. Cl. ..... 165/140; 165/41; 165/67; 165/144; 180/68.4

(58) Field of Search ..... 165/41, 51, 67, 165/69, 78, 140, 144, 149; 180/68.4

(56) References Cited

U.S. PATENT DOCUMENTS

| | | | | | |
|---|---|---|---|---|---|
| 1,805,101 | A | * | 5/1931 | Modine | 165/140 |
| 2,013,186 | A | * | 9/1935 | Price | 165/144 |
| 2,237,516 | A | * | 4/1941 | Young | 165/144 |
| 4,417,635 | A | * | 11/1983 | Thepault | 180/68.4 |
| 4,651,816 | A | | 3/1987 | Struss et al. | 165/140 |
| 4,706,461 | A | * | 11/1987 | Pratt et al. | 165/51 |
| 4,763,723 | A | * | 8/1988 | Granetzke | 165/67 |
| 4,770,234 | A | * | 9/1988 | Hiraoka et al. | 165/67 |
| 5,197,538 | A | * | 3/1993 | Nagasaka et al. | 165/144 |
| 5,234,051 | A | * | 8/1993 | Weizenburger et al. | 165/67 |
| 5,441,100 | A | * | 8/1995 | Ueda et al. | 165/67 |
| 5,566,748 | A | * | 10/1996 | Christensen | 165/67 |

FOREIGN PATENT DOCUMENTS

| | | | | |
|---|---|---|---|---|
| EP | 211253 A1 | * | 2/1987 | 180/68.4 |
| GB | 2262600 A | * | 6/1993 | 165/140 |
| JP | 61-50807 | | 11/1986 | |
| JP | 4-33131 | | 8/1992 | |
| JP | 8-218866 | | 8/1996 | |
| JP | 9-30244 | | 2/1997 | |
| JP | 2555867 | | 8/1997 | |
| JP | 11-301514 | | 11/1999 | |
| JP | 2000-2496 | | 1/2000 | |
| WO | 98/09124 | | 3/1998 | |

* cited by examiner

*Primary Examiner*—Leonard R. Leo
(74) *Attorney, Agent, or Firm*—Oblon, Spivak, McClelland, Maier & Neustadt, P.C.

(57) ABSTRACT

An integrated heat exchanger is constituted by different kinds of heat exchangers such as a radiator for use in engine-cooling systems and a condenser for use in air-conditioning systems which is low in manufacturing cost, small in thickness, easy in maintenance and/or replacement and small in air pressure loss. The heat exchanger includes a first heat exchanger (2) and a second heat exchanger (3). A fitting dented portion (6) is provided at one of a bottom surface of the first heat exchanger (2) and an upper surface of the second heat exchanger (3), and a fitting protruded portion (5) is provided at the other thereof, and wherein the fitting protruded portion (5) is fitted in the fitting dented portion (6), whereby the first heat exchanger (2) is integrally conected to the upper surface of the second heat exchanger (3).

14 Claims, 5 Drawing Sheets

INTEGRATED HEAT EXCHANGER

CROSS REFERENCE TO RELATED APPLICATIONS

This application is an application filed under 35 U.S.C. §111(a) claiming the benefit pursuant to 35 U.S.C. §119(e)(1) of the filing date of Provisional Application No. 60/302,383 filed Jul. 3, 2001 pursuant to 35 U.S.C. §111(b).

TECHNICAL FIELD

The present invention relates to an integrated heat exchanger in which different kinds of heat exchangers, such as a radiator for use in engine-cooling systems and a condenser for use in air-conditioning systems, are integrally connected with each other.

BACKGROUND ART

Conventionally, a radiator for use in automobile engine-cooling systems and a condenser for use in automobile air-conditioning systems are separately mounted on an automobile body such that the condenser is arranged in front of the radiator.

On the other hand, in order to reduce the steps for mounting these heat exchangers to the automobile body and its labor hours, it is proposed to share a header by the radiator and the condenser.

According to the former structure wherein the radiator and the condenser are separately mounted on the automobile body, it is difficult to decrease the thickness as a whole heat exchanger including the radiator and the condenser, resulting in a thick integrated heat exchanger. Furthermore, since the radiator and the condenser are juxtaposed fore and aft, i.e., in an air-flow direction, it is difficult to reduce the air-pressure loss across the whole heat exchanger.

According to the latter structure wherein a header is shared by the radiator and the condenser, the steps for maintaining and/or replacing the radiator and/or the condenser increase. Furthermore, since such a special header structure is employed, a forming die corresponding to the special structure should be newly manufactured, resulting in an increased equipment cost.

It is an object of the present invention to provide an integrated heat exchanger including different kinds of heat exchangers which is low in manufacturing cost, small in thickness and air-pressure loss, easy in maintenance and/or replacement and excellent in performance.

DISCLOSURE OF INVENTION

The aforementioned object is attained by an integrated heat exchanger comprising a first heat exchanger 2 and a second heat exchanger 3, wherein a fitting dented portion 6 is provided at one of a bottom surface of the first heat exchanger 2 and an upper surface of the second heat exchanger 3, and a fitting protruded portion 5 is provided at the other thereof, and wherein the fitting protruded portion 5 is fitted in the fitting dented portion 6, whereby the first heat exchanger 2 is integrally connected to the upper surface of the second heat exchanger 3.

In the aforementioned integrated heat exchanger, the integration of the first and second heat exchangers 2 and 3 can be performed by providing the fitting protruded portion 5 on one of the bottom surface of the first heat exchanger 2 and the upper surface of the second heat exchanger 3 and the fitting dented portion 6 on the other thereof almost without changing the existing structure of the first and second heat exchangers 2 and 3. Therefore, almost no new investment for manufacturing equipment is required, resulting in a low manufacturing cost. Furthermore, since the first and second heat exchangers 2 and 3 do not share a header as in the aforementioned conventional heat exchanger but are separately manufactured and then integrally connected with each other, the manufacturing and/or replacing work can be performed easily without increasing the manufacturing and/or replacing steps. Furthermore, since the first heat exchanger 2 is connected to the upper portion of the second heat exchanger 3, in cases where the first heat exchanger 2 is a radiator, the cooling-water can be smoothly supplied to the radiator 2. Since the first and second heat exchangers 2 and 3 are not juxtaposed so as to form two rows but disposed one on the other so as to form a single row, the thickness can be reduced, resulting in reduced air-pressure loss as a whole heat exchanger, which in turn results in a high-performance heat exchanger.

It is preferable that the fitting protruded portion 5 is fitted in the fitting dented portion 6 via a buffer member 30 made of elastic material. Even in cases where there are some dimensional errors in the first and second heat exchangers 2 and 3, since the buffer member 30 can absorb such errors, the first and second heat exchangers 2 and 3 can be integrally connected with each other without difficulty. Furthermore, even if the heat exchangers vibrate, due to the existence of the buffer member 30, the first and second heat exchangers 2 and 3 will not be interfered each other, resulting in enhanced resistance to vibration.

It is preferable that at least one downwardly protruded protrusion 40 is provided at the bottom surface of the first heat exchanger 2, wherein a channel member 19 having a generally U-shaped cross-section is provided at the upper surface of the second heat exchanger 3 so as to extend along a widthwise direction thereof, and wherein the protrusion 40 is fitted in the channel member 19, whereby the first and second heat exchangers 2 and 3 are connected with each other and almost no gap or no gap is formed between the first and second heat exchangers 2 and 3 by the channel member 19 to prevent air passage therebetween. In this case, the first and second heat exchangers 2 and 3 can be connected more firmly with each other, and the cooling performance will be further improved by the prevention of air passage between the first and second heat exchangers 2 and 3.

It is also preferable that the first heat exchanger 2 includes a pair of horizontally disposed upper and lower tank portions 21 and 21 and a plurality of tubes 23 connecting the upper and lower tank portions 21 and 21, wherein the second heat exchanger 3 includes a pair of vertically disposed right and left headers 15 and 15 and a plurality of tubes 12 connecting the right and left headers 15 and 15, wherein a left-hand side fitting protruded portion 5 is provided at one of a bottom surface of a left end portion of the lower tank portion 21 of the first heat exchanger 2 and an upper portion of the left header 13, and a left-hand side fitting dented portion 6 is provided at the other thereof, wherein a right-hand side fitting protruded portion 5 is provided at one of a bottom surface of a right end portion of the lower tank portion 21 of the first heat exchanger 2 and an upper end portion of the right header 15 of the second heat exchanger 3, and a right-hand side fitting dented portion 6 is provided at the other thereof, and wherein the left-hand side fitting protruded portion 5 is fitted in the left-hand side fitting dented portion 6 and the right-hand side fitting protruded portion 5 is fitted in the right-hand side fitting dented portion 6, whereby the first heat exchanger 2 is integrally connected to an upper portion of the second heat exchanger 3. In this case, the connection of the first and second heat exchangers 2 and 3 can be performed easily and both the heat exchangers can be integrally connected with each other more stably.

It is also preferable that the fitting dented portions 6 and 6 are provided at the bottom surfaces of right and left end portions of the lower tank portion 21 of the first heat exchanger 2, and the fitting protruded portions 5 and 5 are provided at upper ends of the right and left headers 15 and 15 of the second heat exchanger 3. According to this structure, the gap between the first and second heat exchangers 2 and 3 can be further decreased, and the weight as a whole heat exchanger can be further reduced. In cases where the tank portion 21 of the first heat exchanger 2 is made of resin, since the fitting dented portion 6 can be simultaneously formed at the time of molding the tank portion 21, the productivity can be improved and the manufacturing cost can be further reduced. Furthermore, since the fitting protruded portions 5 and 5 are just added to the second heat exchanger 3, the structure of the second heat exchanger 3 can be kept simple in structure, resulting in enhanced productivity and a reduced manufacturing cost.

The present invention can be suitably applied to an integrated heat exchanger including a radiator for use in automobile engine-cooling systems and a condenser for use in automobile air-conditioning systems.

BEST MODE FOR CARRYING OUT THE INVENTION

Figure 1:
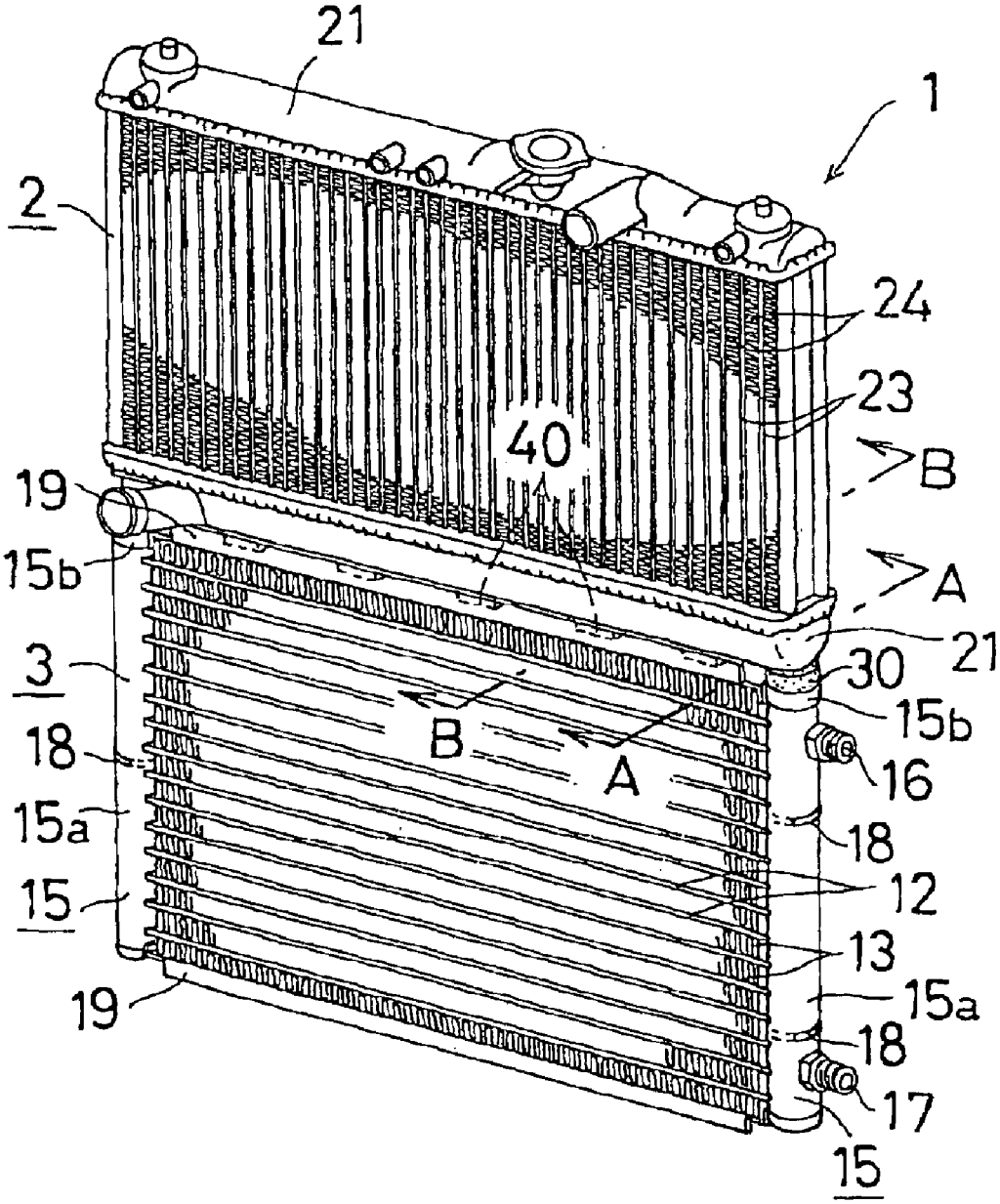
FIG. 1 is a perspective view showing an integrated heat exchanger according to an embodiment of the present invention.

The whole structure of an integrated heat exchanger according to one embodiment of the present invention is shown in FIG. 1.

The upper heat exchanger is a radiator 2 for use in engine-cooling systems and the lower heat exchanger is a condenser 3 for use in air-conditioning systems.

In the aforementioned condenser 3 or the lower heat exchanger, the reference numeral 12 denotes a flat tube, and 13 denotes a corrugated fin. The tubes 12 and corrugated fins 13 are horizontally disposed in parallel with each other and alternatively arranged in a vertical direction. The reference numerals 15 and 15 denote a pair of right and left headers to which opposite ends of the flat tubes 12 are connected in fluid communication. The aforementioned flat tube 12 is the so-called harmonica tube which is an aluminum extruded article in which the inside space is divided into a plurality of flow passages by partitioning walls each extending along the longitudinal direction thereof to enhance thermal conductivity and pressure resistance. The aforementioned corrugated fin 13 is a corrugated sheet with louvers. The corrugated sheet is an aluminum brazing sheet comprising an aluminum base sheet and a brazing layer clad thereon. The corrugated fin 13 may be a normal aluminum sheet in place of the aforementioned aluminum brazing sheet. The aforementioned header 15 is comprised of a header pipe 15*a* made by curving an aluminum brazing sheet with a clad brazing layer into a pipe so as to abut opposite side edges and a pair of header caps 15*b* each outwardly fitted on the end opening portion of the header pipe 15*a*.

A plurality of tube insertion apertures are provided in the peripheral wall of the header pipe 15*a* at predetermined intervals along the longitudinal direction thereof, and both ends of each tube 12 are inserted into the tube insertion apertures.

Figure 5:
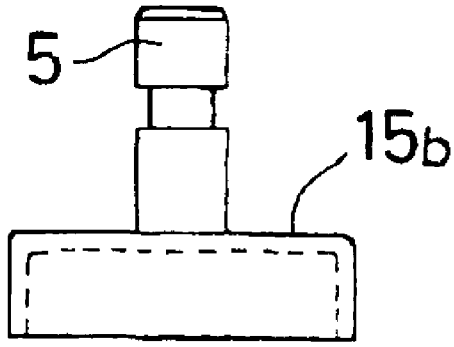
FIG. 5 is a side view showing a header cap.

As shown in FIG. 5, the header cap 15*b*, which is fitted on the upper end opening portion of the header pipe 15*a*, is provided with a pin-shaped fitting protrusion 5 outwardly extending along the axial direction of the header pipe 15*a* at the central portion of the upper surface of the header cap 15*b*.

As shown in FIG. 1, a refrigerant inlet 16 is connected to the upper outside of the right header 15, and a refrigerant outlet 17 is connected to the lower outside of the right header 15. Furthermore, the partitioning plate 18 for dividing the inner space of the header 15 in the longitudinal direction is provided in the right and left headers 15 and 15, whereby the refrigerant introduced into the right header 15 through the refrigerant inlet 16 passes through the whole refrigerant passages constituted by the tubes 12 in a meandering manner and flows out of the refrigerant outlet 17. While passing through the whole refrigerant passages, the refrigerant exchanges heat with air passing through the air gaps formed between the adjacent tubes 12 and 12 including the corrugated fin 13 to be condensed. The reference numeral 19 denotes a side plate disposed on the outermost corrugated fin 13.

Next, the structure of the radiator 2 or the upper heat exchanger will be explained.

Figure 2:
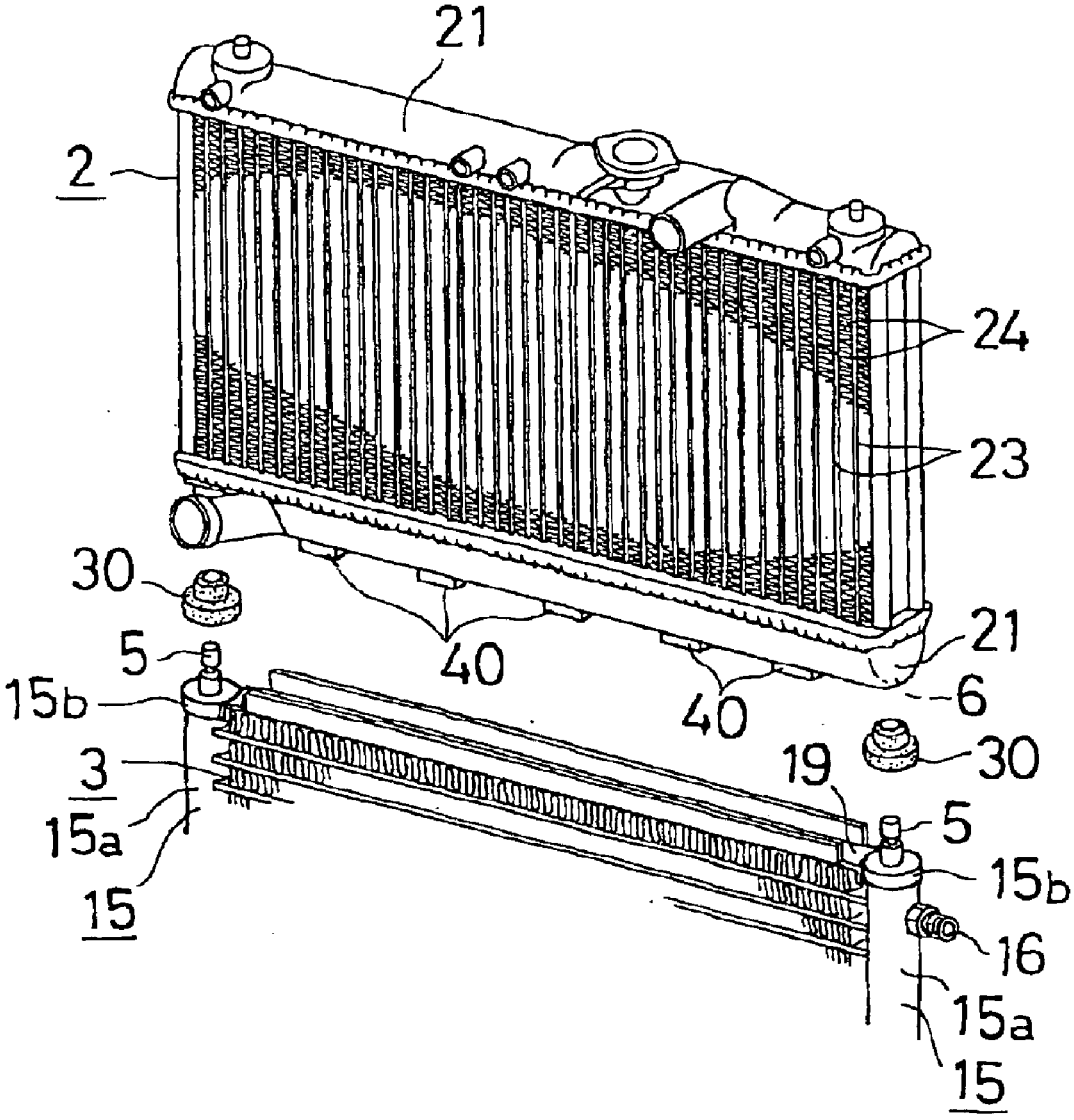
FIG. 2 is a partial perspective view showing the integrated heat exchanger in a disassembled state.
Figure 3:
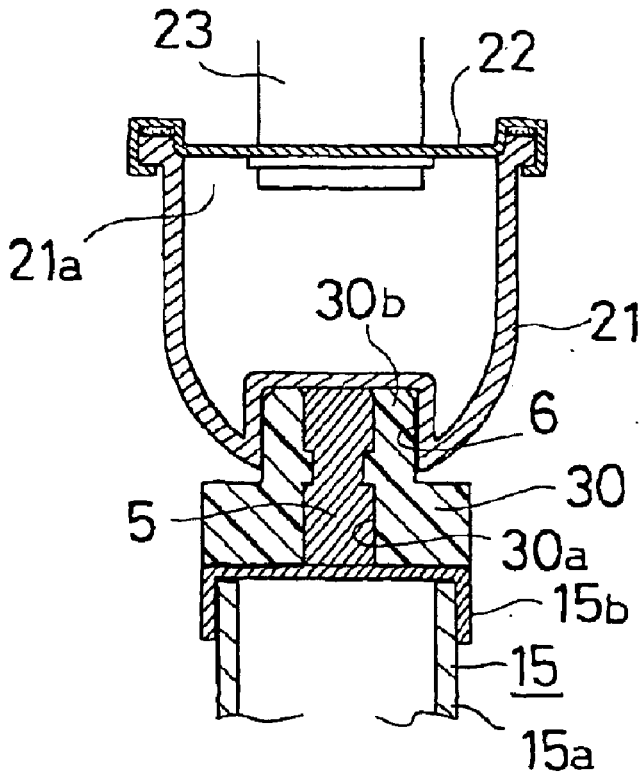
FIG. 3 is an enlarged cross-sectional view taken along the line A—A in FIG. 1.
Figure 4:
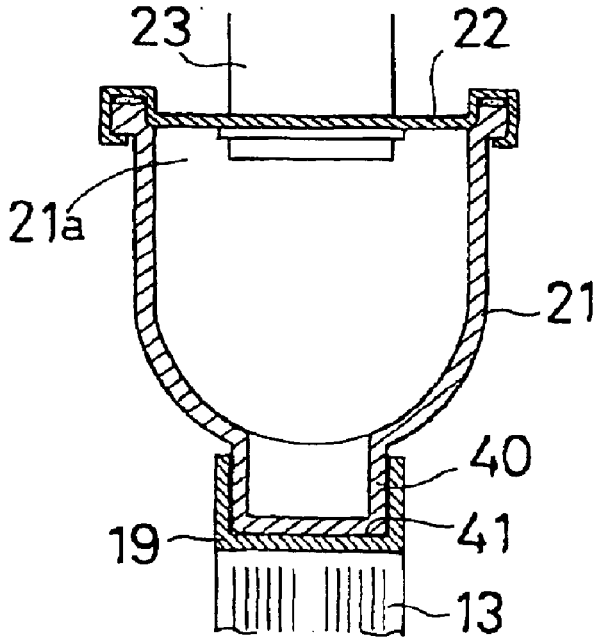
FIG. 4 is an enlarged cross-sectional view taken along the line B—B in FIG. 1.

As shown in FIGS. 1 and 2, the radiator 2 includes a pair of horizontally disposed upper and lower tank portions 21 and 21, a plurality of vertically disposed flat tubes 23 and a plurality of corrugated fins 24 interposed between the adjacent tubes 23. As shown in FIGS. 3 and 4, the lower tank 21 includes a resin molded tank portion having a U-shaped cross-section and a core plate 22 closing the upper opening of the tank portion. A plurality of tubes 23 are in fluid communication with the tank portion 21 through the core plate 22.

As shown in FIG. 3, at the bottom surfaces of the right and left end portions of the resin molded lower tank 21, fitting dented portions 6 and 6 are formed.

In this embodiment, the radiator 2 and the condenser 3 are integrally connected with each other as follows.

Figure 6:
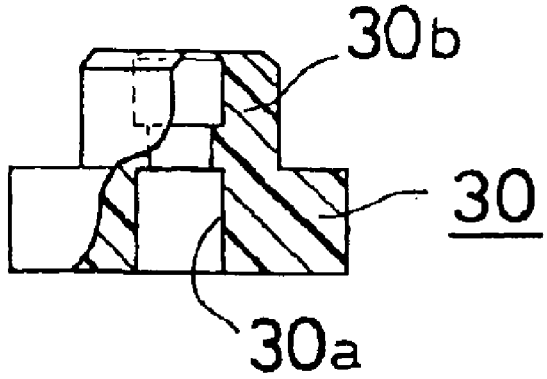
FIG. 6 is a partially broken side view showing a buffer member.

As shown in FIGS. 2 and 3, the fitting protruded portions 5 of the header caps 15*b* of the right and left headers 15 and 15 of the condenser 3 are inserted into the fitting dented portions 6 of the bottom surfaces of the right and left end portions of the lower tank 21 via buffer members 30. Thus, the radiator 2 is integrally connected to the upper portion of the condenser 3. The buffer member 30 is made of elastic material such as rubber or soft synthetic resin, and is provided with a fitting hole 30*a* corresponding to the fitting protruded portion 5 at the central portion thereof and an upwardly protruded fitting protrusion 30*b* as shown in FIG. 6. As shown in FIG. 3, the fitting protruded portion 5 of the header cap 15*b* is fitted in the fitting hole 30*a* of the buffer member 30, whereby the buffer member 30 is firmly fitted on the header cap 15*b*. In this state, the upwardly protruded fitting protrusion 30*b* of the buffer member 30 is fitted in the fitting dented portion 6 of the bottom surface of the lower tank portion 21 of the radiator 2, whereby the radiator 2 is firmly connected to the upper side portion of the condenser 3.

In the aforementioned embodiment, since the fitting protruded portion 5 of the header cap 15*b* is fitted in the fitting dented portion 6 of the bottom surface of the tank portion 21 via the buffer member 30, even if there are some dimensional errors in the radiator 2 and/or the condenser 3, the buffer member 30 absorbs such errors. Thus, the radiator 2 and the condenser 3 can be integrally connected with each other without difficulty. Furthermore, even if the heat exchanger vibrate, the radiator 2 and the condenser 3 will not be interfered each other, resulting in enhanced resistance to vibration. The fitting protruded portion 5 of the header cap 15*b* of the condenser 3 may be directly inserted into the fitting dented portion 6 formed at the bottom surfaces of the right and left end portions of the tank portion 21 of the radiator 2. However, considering the advantages that the buffer member 30 can improve the resistance to vibration, it is preferable to intervene a buffer member 30 between the fitting protruded portion 5 and the fitting dented portion 6 as shown in this embodiment.

In this embodiment, the following structure is also employed. As shown in FIGS. 2 and 4, a plurality of protrusions 40 are provided at the bottom surface of the lower tank portion 21 of the radiator 2. On the other hand, a pair of upwardly extended side walls are formed along the side edges of the upper side plate 19 of the condenser 3. Thus, the side plate 19 has a generally U-shaped fitting concave portion 41. As shown in FIG. 4, each protrusion 40 is fitted in the fitting concave portion 41, whereby almost no gap or no gap is formed between the lower tank portion 21 of the radiator 2 and the upper side plate 19 of the condenser 3 to prevent air passage therebetween. This improves the cooling ability of the condenser 3.

In this embodiment, although the fitting concave portions 6 and 6 are formed on the bottom surfaces of the right and left end portions of the lower tank portion 21 of the radiator 2 and the fitting protruded portions 5 are formed on the upper portions of the right and left headers 15 and 15 of the condenser 3, the present invention is not limited to this structure. For example, the radiator 2 and the condenser 3 may be integrally connected with each other by inserting fitting protruded portions 5 formed on the bottom surface of the right and left end portions of the lower tank portion 21 of the radiator 2 into fitting dented portions 6 formed on the upper portions of the right and left headers 15 and 15 of the condenser 3. Alternatively, the radiator 2 and the condenser 3 may be integrally connected with each other by inserting a fitting protruded portion 5 formed on the bottom surface of one of the right and left end portions of the lower tank portion 21 of the radiator 2 into a fitting dented portion 6 formed on the upper surface of one of the right and left headers 15 and 15 of the condenser 3 and inserting a fitting protruded portion 5 formed on the upper surface of the other of the right and left headers 15 and 15 of the condenser 3 into a fitting concave portion 6 formed on the bottom surface of the other of the right and left end portions of the lower tank portion 21 of the radiator 2.

Figure 7:
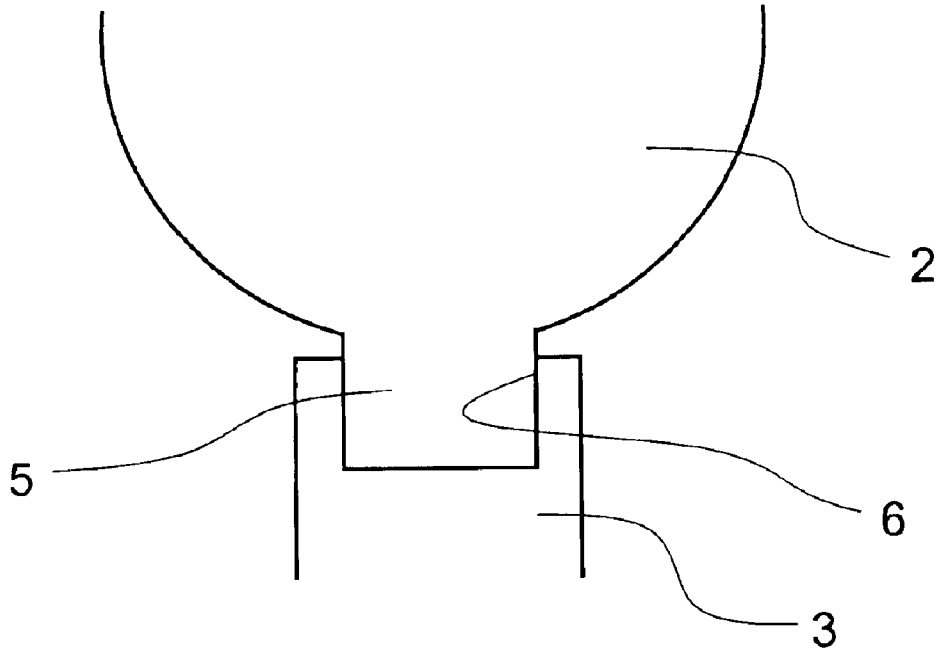
FIG. 7 is a schematic side view showing a fitting dented portion provided at the upper surface of the second heat exchanger and a fitting protruded portion provided at the bottom surface of the first heat exchanger.

Referring to FIG. 7, a fitting dented portion 6 may be provided at the upper surface of the second heat exchanger 3, and a fitting protruded portion 5 may be provided at the bottom surface of the first heat exchanger 2.

Although the aforementioned embodiment is applied to an integrated heat exchanger for automobiles, the present invention is not limited to this and can be widely applied to various heat exchangers.

Effects of the Invention

With the integrated heat exchanger according to the present invention, the integration of the first and second heat exchangers 2 and 3 can be performed by providing the fitting protruded portion 5 on one of the bottom surface of the first heat exchanger 2 and the upper surface of the second heat exchanger 3 and the fitting dented portion 6 on the other thereof almost without changing the existing structure of the first and second heat exchangers 2 and 3. Therefore, almost no new investment in manufacturing equipment is required, resulting in a low manufacturing cost. Furthermore, since the first and second heat exchangers 2 and 3 which are separately manufactured are integrally connected, the manufacturing and/or replacing steps thereof will not be increased, resulting in an easy manufacturing and/or replacing work. Furthermore, since the first heat exchanger 2 is connected to the upper portion of the second heat exchanger 3, in cases where the first heat exchanger 2 is a radiator, the cooling-water can be smoothly supplied to the radiator 2. Since the first and second heat exchangers 2 and 3 are not juxtaposed fore and aft so as to form two rows but arranged one on the other so as to form a single row, the thickness can be reduced, resulting in reduced air-pressure loss as a whole heat exchanger, which results in a high-performance heat exchanger.

In cases where the fitting protruded portion 5 is fitted in the fitting dented portion 6 via the buffer member 30 made of elastic material, even in cases where there are some dimensional errors in the first and second heat exchangers 2 and 3, the first and second heat exchangers 2 and 3 can be integrally connected with each other without difficulty since the buffer member 30 can absorb such errors. Furthermore, even if the heat exchangers vibrate, due to the existence of the buffer member 30, the first and second heat exchangers 2 and 3 will not be interfered each other, resulting in enhanced resistance to vibration.

In cases where at least one downwardly protruded protrusion 40 is provided at the bottom surface of the first heat exchanger 2, a channel member 19 having a generally U-shaped cross-section is provided at the upper surface of the second heat exchanger so as to extend along a widthwise direction thereof, and the protrusion 40 is fitted in the channel member 19, whereby the first heat exchanger 2 and the second heat exchanger 3 are connected with each other and almost no gap or no gap is formed between the first and second heat exchangers 2 and 3 by the channel member 19 to prevent air passage therebetween, the first heat exchanger 2 and the second heat exchanger 3 can be connected more firmly, and the cooling performance will be further improved by the prevention of air passage between the heat exchangers 1 and 2.

In cases where the first heat exchanger 2 includes a pair of horizontally disposed upper and lower tank portions 21 and 21 and a plurality of tubes 23 connecting the upper and lower tank portions 21 and 21, wherein the second heat exchanger 3 includes a pair of vertically disposed right and left header portions 15 and 15 and a plurality of tubes 12 connecting the right and left header portions 15 and 15, wherein a left-hand side fitting protruded portion 5 is provided at one of a bottom surface of the lower tank portion 21 of the first heat exchanger 2 and an upper portion of the left header 13, and a left-hand side fitting dented portion 6 is provided at the other thereof, wherein a right-hand side fitting dented portion 6 is provided at one of a right end portion of the bottom surface of the lower tank portion 21 of the first heat exchanger 2 and an upper end portion of the right header 15 of the second heat exchanger 3, and a right-hand side fitting protruded portion 5 is provided at the other thereof, and wherein the left-hand side fitting protruded portion 5 is fitted in the left-hand side fitting dented portion 6 and the right-hand side fitting protruded portion 5 is fitted in the right-hand side fitting dented portion 6, whereby the first heat exchanger 2 is integrally connected to an upper portion of the second heat exchanger 3, the connection of the first and second heat exchanger 2 and 3 can be performed easily and both the heat exchangers 2 and 3 can be integrally connected with each other more stably.

In cases where the fitting dented portions 6 and 6 are provided at the bottom surfaces of the right and left end portions of the lower tank portion 21 of the first heat exchanger 2 and the fitting protruded portions 5 and 5 are provided at upper ends of right and left headers 15 and 15 of the second heat exchanger 3, the gap between the first and second heat exchangers 2 and 3 can be further decreased, and the weight as a whole heat exchanger can be further reduced. In cases where the tank portion 21 of the first heat exchanger 2 is made of resin, since the fitting dented portion 6 can be simultaneously formed at the time of molding the tank portion 21, the productivity can be improved and the manufacturing cost can be further reduced. Furthermore, since a fitting protruded portion 5 is just added to the second heat exchanger 3, the structure of the second heat exchanger 3 can be kept simple in structure, resulting in enhanced productivity and a reduced manufacturing cost.

INDUSTRIAL APPLICABILITY

The present invention can be suitably applied to an integrated heat exchanger in which a radiator for use in automobile engine-cooling systems and a condenser for use in automobile air-conditioning systems are integrally connected with each other. However, the present invention is not limited to the above, and can also be applied to various heat exchangers in which a plurality of heat exchangers are integrally connected with each other.

What is claimed is:

1. An integrated heat exchanger, comprising:

a first heat exchanger; and a second heat exchanger, wherein a fitting dented portion is provided at one of a bottom surface of said first heat exchanger and an upper surface of said second heat exchanger, and a fitting protruded portion is provided at the other thereof, wherein said fitting protruded portion is fitted in said fitting dented portion, whereby said first heat exchanger is integrally connected to said upper surface of said second heat exchanger, wherein said first heat exchanger includes a pair of horizontally disposed upper and lower tank portions and a plurality of tubes connecting said upper and lower tank portions, and wherein said second heat exchanger includes a pair of vertically disposed right and left header portions and a plurality of tubes connecting said right and left header portions.

2. The integrated heat exchanger as recited in claim 1, wherein said fitting protruded portion is fitted in said fitting dented portion via a buffer member made of elastic material.

3. The integrated heat exchanger as recited in claim 2, wherein at least one downwardly protruded protrusion is provided at said bottom surface of said first heat exchanger, wherein a channel member having a generally U-shaped cross-section is provided at said upper surface of said second heat exchanger so as to extend along a widthwise direction thereof, and wherein said protrusion is fitted in said channel member, whereby said first heat exchanger and said second heat exchanger are connected with each other and almost no gap or no gap is formed between said first and second heat exchangers by said channel member to prevent air passage therebetween.

4. The integrated heat exchanger as recited in claim 1, wherein at least one downwardly protruded protrusion is provided at said bottom surface of said first heat exchanger, wherein a channel member having a generally U-shaped cross-section is provided at said upper surface of said second heat exchanger so as to extend along a widthwise direction thereof, and wherein said protrusion is fitted in said channel member, whereby said first heat exchanger and said second heat exchanger are connected with each other and almost no gap or no gap is formed between said first and second heat exchangers by said channel member to prevent air passage therebetween.

5. The integrated heat exchanger as recited in claim 1, wherein a left-hand side fitting protruded portion is provided at one of a bottom surface of said lower tank portion of said first heat exchanger and an upper portion of said left header, and a left-hand side fitting dented portion is provided at the other thereof, wherein a right-hand side fitting protruded portion is provided at one of a right end portion of said bottom surface of said lower tank portion of said first heat exchanger and an upper end portion of said right header of said second heat exchanger, and a right-hand side fitting dented portion is provided at the other thereof, and wherein said left-hand side fitting protruded portion is fitted in said left-hand side fitting dented portion and said right-hand side fitting protruded portion is fitted in said right-hand side fitting dented portion, whereby said first heat exchanger is integrally connected to an upper portion of said second heat exchanger.

6. The integrated heat exchanger as recited in claim 5, wherein said fitting dented portions are provided at said bottom surfaces of right and left end portions of said lower tank portion of said first heat exchanger, and said fitting protruded portions are provided at upper ends of right and left headers of said second heat exchanger.

7. The integrated heat exchanger as recited in claim 6, wherein said fitting protruded portion is fitted in said fitting dented portion via a buffer member made of elastic material.

8. The integrated heat exchanger as recited in claim 6, wherein at least one protrusion is provided at said bottom surface of said lower tank portion of said first heat exchanger, wherein a side plate having a generally U-shaped cross-section is provided between upper portions of said right and left headers of said second heat exchanger, and wherein said protrusion is fitted in said side plate, whereby said first and second heat exchangers are connected with each other and almost no gap or no gap is formed between said first and second heat exchangers by said side plate to prevent air passage therebetween.

9. The integrated beat exchanger as recited in claim 5, wherein said fitting protruded portion is fitted in said fitting dented portion via a buffer member made of elastic material.

10. The integrated heat exchanger as recited in claim 5, wherein at least one protrusion is provided at said bottom surface of said lower tank portion of said first heat exchanger, wherein a side plate having a generally U-shaped cross-section is provided between upper portions of said right and left headers of said second heat exchanger, and wherein said protrusion is fitted in said side plate, whereby said first and second heat exchangers are connected with each other and almost no gap or no gap is formed between said first and second heat exchangers by said side plate to prevent air passage therebetween.

11. The integrated heat exchanger as recited in claim 1, wherein at least one protrusion is provided at said bottom surface of said lower tank portion of said first heat exchanger, wherein a side plate having a generally U-shaped cross-section is provided between upper portions of said right and left headers of said second heat exchanger, and wherein said protrusion is fitted in said side plate, whereby said first and second heat exchangers are connected with each other and almost no gap or no gap is formed between said first and second heat exchangers by said side plate to prevent air passage therebetween.

12. The integrated heat exchanger-as recited in claim 1, wherein each of said first and second heat exchangers is a heat exchanger for automobiles.

13. The integrated heat exchanger as recited in claim 12, wherein said first heat exchange is a radiator for use in engine-cooling systems and said second heat exchanger is a condenser for use in air-conditioning systems.

14. An integrated heat exchanger, comprising:

a radiator for use in car engine-cooling systems; and a condenser for use in car air-conditioning systems, said condenser being integrally connected to said radiator, wherein said radiator includes a pair of horizontally disposed upper and lower tank portions and a plurality of tubes connecting said tank portions, wherein said condenser includes a pair of vertically disposed right and left header portions and a pair of tubes connecting said header portions, wherein fitting dented portions are provided at bottom surfaces of right and left end portions of said lower tank portion of said radiator, and fitting protruded portions are provided at upper ends of right and left headers of said condenser, wherein said fitting protruded portions are fitted in said fitting dented portions via buffer members made of elastic material, whereby said radiator is integrally connected to an upper portion of said condenser, wherein at least one protrusion is provided at said bottom surface of said lower tank portion of said radiator, and a side plate having a generally U-shaped cross-section is provided between upper portions of said right and left headers of said condenser, and wherein said protrusion is fitted in said side plate whereby said first and second heat exchangers are connected with each other and almost no gap or no gap is formed between said radiator and said condenser by said side plate to prevent air passage therebetween.

* * * * *